United States Patent [19]

Henthorn

[11] Patent Number: 4,714,250

[45] Date of Patent: Dec. 22, 1987

[54] GOLF BALL AND TEE SETTER

[76] Inventor: Clyde E. Henthorn, 4766 Echorock Dr., Columbus, Ohio 43229

[21] Appl. No.: 773,315

[22] Filed: Sep. 6, 1985

[51] Int. Cl.[4] ..... A63B 57/00

[52] U.S. Cl. ..... 273/32.5; 294/19.2

[58] Field of Search ..... 273/32.5, 162 E, 32 F, 273/32 B; 135/81; 294/19.2, 28, 50.6, 50.8

[56] References Cited

U.S. PATENT DOCUMENTS

| | | | |
|---|---|---|---|
| 458,614 | 9/1891 | Buddenberg | 294/19.2 |
| 2,230,498 | 2/1941 | Loos et al. | 294/50.8 |
| 2,943,856 | 7/1960 | Eimerman | 273/32.5 |
| 3,031,683 | 5/1962 | Hellwig | 294/19.2 |
| 4,013,295 | 3/1977 | Baughman | 273/32.5 |
| 4,526,369 | 7/1985 | Phelps | 273/32.5 |
| 4,616,826 | 10/1986 | Trefts | 273/32.5 |

FOREIGN PATENT DOCUMENTS

| | | | |
|---|---|---|---|
| 1457651 | 9/1966 | France | 294/19.2 |
| 412707 | 7/1934 | United Kingdom | 294/19.2 |

*Primary Examiner*—Richard C. Pinkham
*Assistant Examiner*—T. Brown
*Attorney, Agent, or Firm*—Thomas S. Baker, Jr.

[57] ABSTRACT

A golf ball and tee setter for simultaneously holding a ball and tee prior to inserting a tee into the ground and for releasing the ball and tee with the ball remaining in the teed position subsequent to inserting the tee into the ground. The tee setter has an elongated handle and a pair of opposed cup members pivotally attached to one end of the handled. The cup members are arranged to simultaneously hold a golf ball and tee when in a closed position and to release the ball and tee when in an open position. The cup members are normally held in the closed position by a spring biasing element and are moved to the open position by a hand operated mechanism accessible at the other end of the handle, the hand operated mechanism being attached to the pivoted cup members. The apparatus is so designed that a player may set a ball and tee in place from a standing position.

6 Claims, 4 Drawing Figures

GOLF BALL AND TEE SETTER

BACKGROUND OF THE INVENTION

Golf is an outdoor sport in which a player must perform some tasks which require moderate amounts of physical exertion and strength. The work of some of these tasks has been lessened by utilizing a machine. As an example, a player may ride a vehicle instead of walking between holes. However, the development of mechanical devices to reduce the work of some other tasks which, may be difficult for some people to perform, has not received wide attention. As a example, it is necessary for a player to insert a tee into the ground and mount a ball on the tee at each tee area. Typically, a player must hold a golf ball and tee in his hand as an assembly, bend his knees or lean over at the waist, and apply a downward force on the ball to drive the lower end of the tee into the ground. If the ground is hard, this task may be difficult or even impossible for people who have relatively weak hands and/or wrists such as older people or women. Additionally, people who have trouble bending their knees or leaning over at the waist, such as some older people or some handicapped people, also may be unable to set a ball and tee assembly into the ground. Presently, there is no readily available device which will enable a player to set a ball and tee assembly in the ground from a standing position with a minimum of effort. Consequently, some people are unable to participate in the sport of golf because they are unable to set a ball and tee in the ground.

In order to enable more older or handicapped people, or women to play golf, it is desirable to provide a device which is adapted to enable a player to set a ball and tee assembly in the ground at a desired location from an upright position with a minimum of effort.

SUMMARY OF THE INVENTION

The present invention is addressed to a golf ball and tee setter which may be operated by a player from an upright or standing position to set a ball and tee in the ground with a minimum of effort. This device is adapted to receive a golf ball and tee assembly, to maintain a closed position to retain the ball and tee assembly until the assembly is set in the ground at a desired location, and to assume an open position to release the ball and tee assembly subsequent to its being set in the ground.

It is an additional feature of the invention to provide a remotely operable golf ball and tee setter which includes a handle having an upper portion and a lower portion and retaining means located about the lower portion and adapted to retain a golf ball and tee assembly for insertion of the tee into the ground wherein the retaining means is movable between an open position and a closed position and is adapted to retain the ball and tee assembly in the closed position and to discharge the ball and tee assembly in the open position. The device also includes an operating means for moving the retaining means between the closed and open positions.

It is a further feature of the invention to provide a remotely operable golf ball and tee setter which includes a handle having an upper portion and a lower portion and cup means adapted to retain a golf ball and tee assembly for insertion of the tee into the ground wherein the cup means is movable between an open position and a closed position and is adapted to retain the ball and tee assembly in the closed position and to discharge the ball and tee assembly in the open position. The ball and tee setter includes attaching means for attaching the cup means about the lower portion of the handle and operating means for moving the cup means between the open and closed position wherein the operating means is operable from about the upper portion of the handle.

Other features of the invention, in part, will be obvious and, in part, will appear hereinafter.

The invention, accordingly, comprises the apparatus and method possessing the construction, combination of elements, arrangement of parts, and steps which are exemplified in the following detailed description.

For a fuller understanding of the nature and features of the invention, reference should be had to the following detailed description taken in conjunction with the accompanying drawings.

DETAILED DESCRIPTION OF THE INVENTION

The present invention provides a golf ball and tee setter which enables a player to set a ball and tee assembly in the ground at a desired location from an upright or standing position with a minimum of effort. The ball and tee setter is adapted to receive a ball and tee assembly, to maintain a closed position to retain the ball and tee assembly while the assembly is being set in the ground and to be operated to an open position to discharge the ball and tee assembly subsequent to its being set in the ground.

Figure 1:
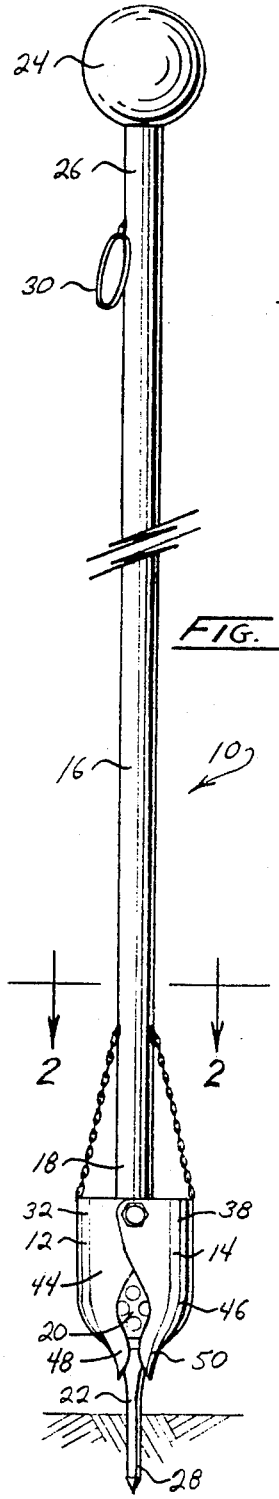
FIG. 1 is a side view with a section cut out of the handle of the ball and tee setter of the present invention in the closed position.
Figure 4:
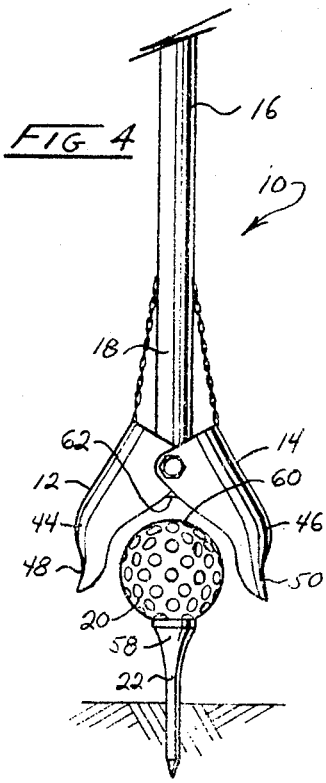
FIG. 4 is a view of the ball and tee setter of the present invention in the open position.

Looking to FIG. 1, ball and tee setter 10 of the present invention includes a pair of oppositely disposed retainer members or cups 12 and 14 which are pivotally attached to tubular handle 16 about its lower portion 18. When cups 12 and 14 are in a closed position as depicted in FIG. 1, an assembly of ball 20 and tee 22 may be retained therebetween. When ball 20 and tee 22 are in this position, a player may set the assembly in the ground from a standing position by applying a downward force on knob 24 mounted at the upper portion 26 of handle 16. This force is transferred directly to ball 20 and tee 22 to drive lower end 28 of tee 22 into the ground. Subsequent to setting the assembly of ball 20 and tee 22 into the ground, cups 12 and 14 are moved to an open position, as illustrated in FIG. 4, by operation of remote actuator 30 at upper portion 26 of handle 16 (FIG. 1). Ball and tee setter 10 then is raised to discharge the assembly therefrom as will be described in more detail hereinafter.

Figure 2:
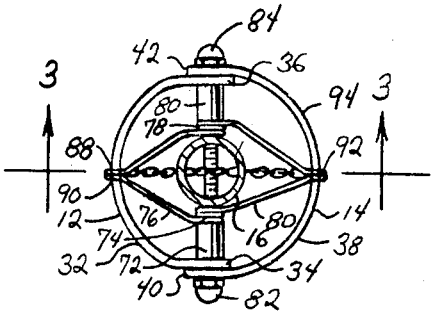
FIG. 2 is a view along line 2—2 of FIG. 1.

Cup 12 has semi-cylindrical upper portion 32 which terminates in a pair of oppositely disposed straight sides 34 and 36 which may be seen by referring to FIG. 2. Similarly, cup 14 has semi-cylindrical upper portion 38 which terminates in a pair of oppositely disposed straight sides 40 and 42. Upper portion 38 of cup 14 has a slightly greater diameter than upper portion 32 of cup 12 such that sides 40 and 42 of cup 14 overlie sides 34 and 36 of cup 12. Cups 12 and 14 have curved lower portions 44 and 46, respectively, which terminate in tapered lips 48 and 50, respectively (FIG. 1). The shapes of lower portions 44 and 46 are such that inner surfaces 52 and 54 of cups 12 and 14 complement the lower outer surface of golf ball 20, as may be seen in FIG. 3. Additionally, the curvatures of tapered lips 48 and 50 are such that the ends of inner surfaces 52 and 54 complement upper outer surface 58 of tee 22. When cups 12 and 14 are in the closed position, their lower portions 44 and 46, respectively, engage outer lower surface 56 of ball 20 and upper outer surface 58 of tee 22 and maintain the top surface 60 of ball 20 in contact with seating surface 62 formed at the lower end of handle 16. Seating surface 62 is formed by flaring the end of handle 16 and is centered between cups 12 and 14.

The pivotal attachment of cups 12 and 14 to lower portion 18 of handle 16 may be seen by referring to FIG. 2. Threaded shaft 70 passes sequentially through a bore in side 40 of cup 14, a bore in side 34 of cup 12, cylindrical spacer 72, a plurality of loops 74 formed on one side of spring 76, a pair of oppositely disposed holes formed in handle 16, a plurality of loops 78 formed in the opposite side of spring 76, cylindrical spacer 80, a bore formed in side 36 of cup 12, and a bore formed in side 42 of cup 14. Head screws 82 and 84 are screwed onto opposite ends of shaft 70. The function of spacers 72 and 80 is to center handle 16 between cups 12 and 14. One end 88 of spring 76 engages top edge 90 of cup 12 intermediate sides 36 and 34, and the other end 92 of spring 76 engages top edge 94 of cup 14 intermediate sides 40 and 42. Ends 80 and 82 of spring 76 are biased downwardly against edges 90 and 94 to bias cups 12 and 14 into the closed position.

Figure 3:
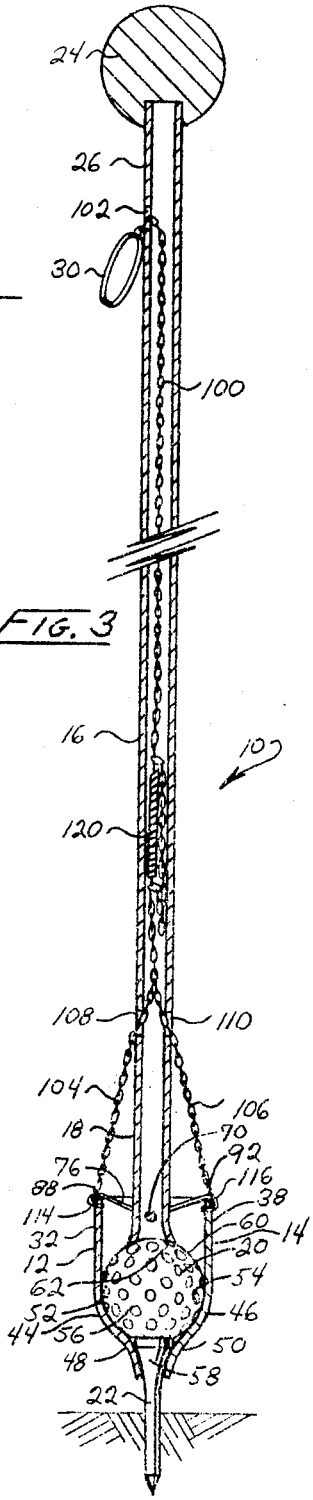
FIG. 3 is a longitudinal sectional view along line 3—3 of FIG. 2 including the upper portion of the handle.

The attachment of actuator 30 to cups 12 and 14 may be observed by referring to FIG. 3. One end of a chain 100 located within tubular handle 16 projects through hole 102 in upper portion 26 of handle 16 and is attached to actuator 30. The opposite end of chain 100 is connected to one end of two short lengths of chain 104 and 106 inside of handle 16. Chains 104 and 106 pass to the outside of handle 16 through holes 108 and 110, respectively. The opposite end of chain 104 is secured in hole 114 in the upper portion 32 of cup 12 immediately below the point where cup 12 is engaged by end 88 of spring 76, and the opposite end of chain 106 is secured in hole 116 formed in upper portion 38 of cup 14 immediately below the point where it is engaged by end 92 of spring 76. Consequently, when actuator 30 is pulled, chains 100, 104, and 106 are tensioned and cups 12 and 14 are rotated about shaft 70 to the open position. It should be noted that actuator 30 is located remote from the assembly of ball 20 and tee 22 and can be actuated by a player in a standing position.

Coil spring 120 is inserted between a length of chain 100 and functions to remove the slack in chain 100 and to tension lightly chains 100, 104, and 106 such that cups 12 and 14 are maintained in an upright position as depicted in FIG. 3. In this position, the longitudinal axis of handle 16 is aligned with the center of ball 20 and with the longitudinal axis of tee 22. Consequently, a downward force applied to knob 24 on handle 16 is applied directly through the center of ball 20 and along the axis of tee 22. If chains 100, 104, and 106 were slack, cups 12 and 14 would be free to pivot about the axis of bolt 70 and there would be no assurance that downward force applied along the axis of handle 16 would be applied along the axis of tee 22. If the force were not applied along the axis of tee 22, tee 22 would be set in the ground at an angle and would be unable to support ball 20. Tension created by spring 120 also retains actuator 30 against the side of handle 16. It should be observed that coil spring 120 has a low spring constant such that approximately one-half pound of force applied to actuator 30 will overcome spring 120 and tension chain 100. Spring 76, which biases cups 12 and 14 into the closed position, has a spring constant considerably greater than that of coil spring 120, i.e., on the order of three pounds. Consequently, cups 12 and 14 are maintained in the closed position by spring 76 despite the fact that spring 120 is applying a tensile force to chains 104 and 106 which tends to move cups 12 and 14 to the open position.

Operation of ball and tee setter 10 is as follows. A player holds ball and tee setter 10 by grasping lower portion 18 of handle 16 and squeezes upper portions 32 and 38 of cups 12 and 14 between a thumb and forefinger to cause the cups to move to the open position depicted in FIG. 4. Thereafter, an assembly of ball 20 and tee 22 is inserted between cups 12 and 14, the cups are released, and spring 76 moves the cups to the closed position as depicted in FIGS. 1 and 3. Subsequently, ball and tee setter 10 is placed in a vertical position such that end 28 of tee 22 engages the ground and the player, while in an upright position, exerts a downward force on knob 24 of handle 16. This force is transmitted through handle 16, ball 20, and into tee 22 to cause lower end 28 of tee 22 to be driven into the ground. The amount of force can be modulated easily by leaning towards or away from the arm and hand applying the downward force. Because the weight of a player can be shifted towards the arm applying the force, little effort is required to drive tee 22 into the ground. After the assembly of ball 20 and tee 22 is set in the ground, the player pulls actuator 30 while maintaining a downward force on knob 24, to cause cups 12 and 14 to move into the open position. Thereafter, ball and tee setter 10 is lifted vertically while tension is applied to actuator 30 to maintain cups 12 and 14 in the open position to discharge ball 20 and tee 22 as depicted in FIG. 4. Ball and tee setter 10 also can be used to retrieve a golf ball from a cup, from water, etc. In order to retrieve a ball, a player pulls actuator 30 to move cups 12 and 14 to the open position, places cups 12 and 14 around the ball, and releases actuator 30.

Handle 16 and cups 12 and 14 are made out of aluminum. Consequently, ball and tee setter 10 weighs less than one-half pound and it can be carried easily in a golf bag. Handle 16 also could be made to telescope by making it from two concentric tubes. Of ocurse, one of the tubes would have to be slotted to accommodate actuator 30, or actuator 30 and chain 100 would have to be repositioned.

It should be noted that although the preferred embodiment has been described above, the construction of the device may be changed considerably without altering its function. For example, chains 100, 104, and 106 could be replaced with wires, ropes, or even solid rods. Furthermore, actuator 30, which moves the cups between the open and closed positions, could be positioned at the lower portion 18 of handle 16 and could be foot operated such that no bending or leaning of the player is required. Handle 16 could have T-shaped or an L-shaped upper portion 26 and actuator 30 could be positioned such that it would be accessible to a finger on the hand which holds handle 16. With this configuration, a player could operate ball and tee setter 10 with one hand. Additionally, retainer members or cups 12 and 14, which retain the assembly of ball 20 and tee 22 when in the closed position, could have any configuration which properly supports the assembly so that force applied along the axis of handle 16 is applied to the center of ball 20 and along the axis of tee 22 when the assembly is being set into the ground.

From the above it may be seen that the instant invention provides a ball and tee setter which enables a player to set a ball and tee assembly into the ground easily while maintaining an upright (i.e. non-bending) position.

Since certain changes may be made to the above-described apparatus without departing from the scope of the invention herein, it is intended that all matter contained in the description thereof or shown in the accompanying drawings shall be interpreted as illustrative and not in a limiting sense.

What is claimed is:

1. A remotely operable golf ball and tee setter which comprises:

a handle having an upper portion and a lower portion;

retaining means located about said lower portion and adapted to simultaneously retain a golf ball and tee in alignment for insertion of the tee into the ground, said retaining means being movable between an open position and a closed position, and being adapted to retain said ball and tee when in said closed position and to discharge said ball and tee with said ball mounted on said tee when in said open position;

said retaining means includes first and second movable members;

pivotal mounting means for pivotally mounting said first and second members to said handle;

operating means for moving said retaining means between said closed position and said open position;

said operating means including first spring means applying a continuous equal force to each of said first and second movable members and acting to bias said retaining means toward said open position and to align said retaining means such that the axis of said handle is aligned with the axis of said ball and said tee; and second spring means producing a force greater than said first spring means and acting to bias said retaining means toward said closed position.

2. The golf ball and tee setter of claim 1 in which seating means are disposed within said retaining means, said seating means engaging said golf ball when said retaining means is in said closed position; and said seating means includes a surface formed on one end of said handle.

3. The golf ball and tee setter of claim 1 in which, each of said first and second members includes a ball engaging portion and a tee engaging portion, said ball engaging portion has a shape which substantially complements a part of the outer surface of said ball, said tee engaging portion has a shape which substantially complements a part of the outer surface of said tee and said first and second members cooperate to enclose substantially the entire outer surface of said ball.

4. A remotely operable golf ball and tee setter which comprises:

a handle having an upper portion and a lower portion;

retaining means located about said lower portion and adapted to retain a golf ball and tee assembly for insertion of the tee into the ground, said retaining means being movable between an open position and a closed position, and being adapted to retain said ball and tee assembly in said closed postiion and to discharge said ball and tee assembly in said open position; operating means for moving said retaining means between said closed position and said open position;

said retaining means includes first and second movable members;

said operating means includes: a primary element and a pair of secondary elements which are connected to said primary elements, wherein one of said secondary elements is connected to said first member and the other of said secondary elements is connected to said second members; and at least one of said primary and secondary elements is a chain.

5. A remotely operable golf ball and tee setter which comprises:

a handle having an upper portion and a lower portion;

cup means adapted to retain a golf ball and tee for insertion of the tee into the ground, said cup means being comprised of first and second movable members movable between an open position and a closed position, and being adapted to retain said ball and tee when in said closed position and to discharge said ball and tee with said ball mounted on said tee in said open position;

pivotal mounting means for pivotally mounting said first and second movable members to said handle lower portion;

operating means for moving said cup means between said closed position and said open position, said operating means including manual actuating means positioned adjacent the upper portion of said handle;

said operating means further including first spring means attached to said first and second movable members and applying a continuous equal force to each of said first and second movable members and acting to bias said cup means toward said open position and to align said cup means such that the axis of said handle is aligned with the axis of said ball and tee; and second spring means providing a force greater than said first spring means and acting to bias said retaining means toward said closed position.

6. A remotely operable golf ball and tee setter which comprises:

a handle having an upper portion and a lower portion;

cup means adapted to simultaneously retain a golf ball and tee in alignment for insertion of the tee into the ground, said cup means including first and second cup members and being movable between an open position and a closed position, and being adapted to retain said ball and tee when in said closed position and to discharge said ball and tee when in said open position, attaching means including pivotal mounting means for pivotally mounting said first and second cup members to said handle;

operating means for moving said cup means between said closed position and said open position, said operating means being operable from about the upper portion of said handle;

said handle being tubular and said operating means including:

a primary link which extends through a portion of the inside of said handle and a pair of secondary links which are connected to one end of said primary link; and one of said secondary links being connected to said first cup member and the other of said secondary links being connected to said second cup member;

a primary chain;

said one secondary link being a chain;

said other secondary link being a chain;

spring means connected to said primary chain to tension said primary chain and said first and second secondary chains to thereby align the axis of said handle with the center of said first and second cup members.

* * * * *